US009986850B2

(12) United States Patent
Haut et al.

(10) Patent No.: US 9,986,850 B2
(45) Date of Patent: Jun. 5, 2018

(54) CONVERTIBLE HIGHCHAIR ASSEMBLY HAVING A REMOVABLE TRAY

(71) Applicant: Wonderland Nurserygoods Company Limited, Kwai Chung, N.T. (HK)

(72) Inventors: Robert E. Haut, Merion Station, PA (US); Anthony V. Ruggiero, Downington, PA (US); Colin P. Hansel, Philadelphia, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 55 days.

(21) Appl. No.: 14/972,120

(22) Filed: Dec. 17, 2015

(65) Prior Publication Data

US 2016/0174727 A1 Jun. 23, 2016

Related U.S. Application Data

(60) Provisional application No. 62/176,889, filed on Mar. 18, 2015, provisional application No. 62/124,450, filed on Dec. 19, 2014.

(51) Int. Cl.
*A47D 1/00* (2006.01)
*A47D 1/04* (2006.01)
(Continued)

(52) U.S. Cl.
CPC ..... *A47D 11/002* (2013.01); *A47D 1/006* (2013.01); *A47D 1/008* (2013.01); *A47D 1/103* (2013.01); *A47D 1/106* (2013.01); *A47D 1/004* (2013.01)

(58) Field of Classification Search
CPC ..... A47D 11/002; A47D 11/00; A47D 1/006; A47D 1/008; A47D 1/103; A47D 1/106;
(Continued)

(56) References Cited

U.S. PATENT DOCUMENTS 2,496,205 A * 1/1950 Grieb ..... A47D 1/103 297/250.1
2,516,774 A * 7/1950 Gottfried ..... A47D 1/004 297/134
(Continued)

FOREIGN PATENT DOCUMENTS

CN 101416830 B 9/2010
CN 201847233 U 6/2011
(Continued)

OTHER PUBLICATIONS

The Official Action from co-pending German Patent Application No. 102015122122.5 dated Apr. 14, 2016.
(Continued)

*Primary Examiner* — Joshua J Michener
*Assistant Examiner* — Kyle J. Walraed-Sullivan
(74) *Attorney, Agent, or Firm* — Daniel A. Tallitsch; Baker McKenzie

(57) ABSTRACT

A convertible highchair assembly includes a seat frame, a booster seat detachably installable on the seat frame, a tray detachably mountable on the booster seat and having a plurality of sockets, and a plurality of leg extensions selectively attachable to any of the support frame portion and the tray, each of the leg extensions having a connecting end. The seat frame includes a support frame portion and a seat portion affixed with each other, the seat portion being adapted to receive a child. The connecting ends of the leg extensions are attached to the support frame portion for configuring a highchair, and the connecting ends of the leg extensions are respectively inserted into the sockets while the tray is removed from the booster seat for configuring a standalone table, the leg extensions providing standing support for the tray.

21 Claims, 20 Drawing Sheets

(51) Int. Cl.
*A47D 11/00* (2006.01)
*A47D 1/10* (2006.01)

(58) Field of Classification Search
CPC ..... A47D 1/04; A47D 1/0085; A47D 1/002; A47D 1/00; A47C 13/00; A47C 4/02
See application file for complete search history.

(56) References Cited

U.S. PATENT DOCUMENTS 2,529,687 A * 11/1950 Greenbaum ..... A47B 83/02 297/134
2,667,207 A * 1/1954 Magyar ..... A47D 1/004 108/11
4,854,638 A * 8/1989 Marcus ..... A47D 1/103 297/256.11
5,806,922 A * 9/1998 Mendelovich ..... A47D 1/004 297/119
7,673,934 B2 3/2010 Bearup et al.
9,101,225 B2 8/2015 Kostyniak et al.
2003/0067198 A1* 4/2003 Treen ..... A47D 1/002 297/250.1
2005/0248192 A1* 11/2005 Schaller ..... A47D 1/103 297/239
2006/0220349 A1* 10/2006 Wolf ..... A47D 1/02 280/650
2009/0001776 A1* 1/2009 Bearup ..... A47D 1/002 297/153
2009/0315374 A1* 12/2009 Hu ..... A47D 1/004 297/256.16
2011/0074187 A1* 3/2011 Zhong ..... A47D 1/006 297/130
2012/0025569 A1* 2/2012 Bergkvist ..... A47D 1/02 297/174 R
2012/0026000 A1* 2/2012 Chen ..... A47D 1/106 340/687
2013/0241248 A1* 9/2013 Kostyniak ..... A47D 1/00 297/130
2014/0054936 A1* 2/2014 Varney ..... A47D 1/008 297/149
2014/0208987 A1* 7/2014 Varney ..... A47D 1/008 108/28
2014/0265487 A1* 9/2014 Michelson ..... A47D 1/004 297/256.11
2014/0368006 A1* 12/2014 Taylor ..... A47D 1/004 297/188.11
2015/0359354 A1* 12/2015 Greger ..... A47D 1/004 297/134

FOREIGN PATENT DOCUMENTS

DE 92121616.6 U1 1/1993
DE 102014108359 A1 12/2014
EP 2008550 A1 12/2008
EP 2305075 A1 4/2011
GB 2476455 A 6/2011

OTHER PUBLICATIONS

Combined Search and Examination Report for co-pending UK Patent Application No. GB1522274.8 dated May 16, 2016.

* cited by examiner

CONVERTIBLE HIGHCHAIR ASSEMBLY HAVING A REMOVABLE TRAY

CROSS-REFERENCE TO RELATED APPLICATION(S)

This patent application respectively claims priority to U.S. Provisional Patent Application No. 62/124,450 filed on Dec. 19, 2014, and to U.S. Provisional Patent Application No. 62/176,889 filed on Mar. 18, 2015, the disclosures of which are incorporated herein by reference.

BACKGROUND

1. Field of the Invention

The present invention relates to highchair assemblies for children.

2. Description of the Related Art

Highchairs for children typically include a rigid frame on which a seat is supported above the floor, and a tray attached to the seat. Conventional highchairs usually have a large footprint and an oversized tray that may occupy substantial space in a kitchen or a room, which may make it difficult for a caregiver to organize the eating area in a room with limited space. Moreover, most traditional highchairs have a limited sitting space that can only accommodate children of certain age. As the child grows up, the highchair may quickly become unsuitable for seating the child.

For solving the aforementioned problems, some approaches propose a highchair having a removable child seat. The removable child seat can accommodate a young child. When the child seat is removed from the highchair, the larger sitting space of the highchair can receive a child of a higher age. Even if this approach is adapted for accommodating children of different ages, it is still limited to highchair uses.

Therefore, there is a need for an improved highchair design that is more versatile, and can address at least the foregoing issues.

SUMMARY

The present application describes a highchair assembly that is easy to operate, and can be converted to multiple configurations according to the child's age and needs. In one embodiment, the highchair assembly includes a seat frame, a booster seat detachably installable on the seat frame, a tray detachably mountable on the booster seat and having a plurality of sockets, and a plurality of leg extensions selectively attachable to any of the support frame portion and the tray, each of the leg extensions having a connecting end. The seat frame includes a support frame portion and a seat portion affixed with each other, the seat portion being adapted to receive a child. The connecting ends of the leg extensions are attached to the support frame portion for configuring a highchair, and the connecting ends of the leg extensions are respectively inserted into the sockets while the tray is removed from the booster seat for configuring a standalone table, the leg extensions providing standing support for the tray in the configuration of the standalone table.

In some other embodiments, the present application also describes a tray suitable for use with a booster seat. The tray includes a rigid tray body having a plurality of sockets that is attachable to a booster seat, and a plurality of latches assembled with the tray body at locations respectively adjacent to the sockets, the latches being operable to engage with a plurality of leg extensions for providing standing support to the tray as a standalone table.

Advantages of the structures described herein include the ability to provide a highchair assembly that is easy to operate and more versatile in use.

DETAILED DESCRIPTION OF THE EMBODIMENTS

Figure 1:
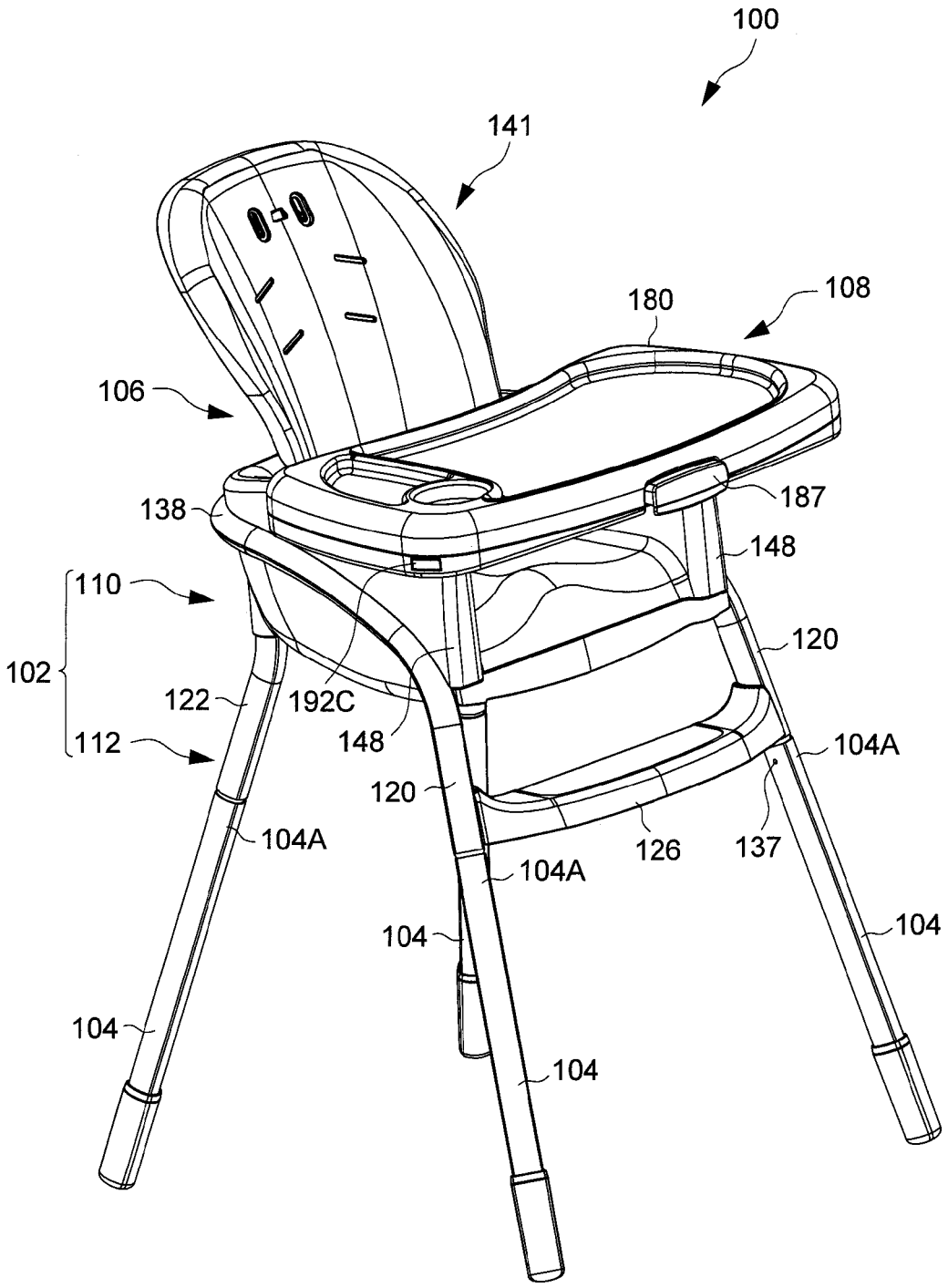
FIG. 1 is a perspective view illustrating an embodiment of a highchair assembly.
Figure 2:
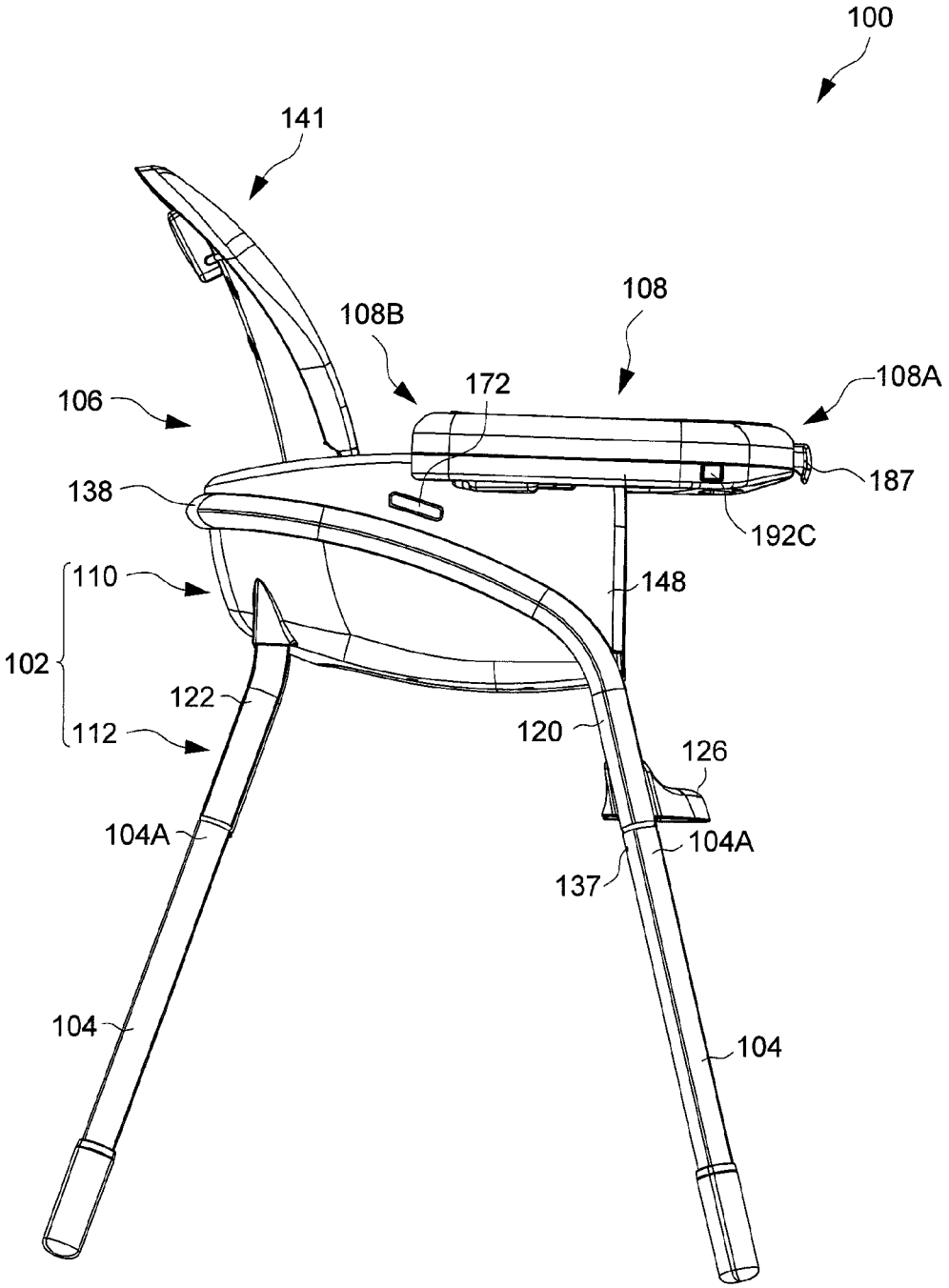
FIG. 2 is a side view of the highchair assembly shown in FIG. 1.
Figure 3:
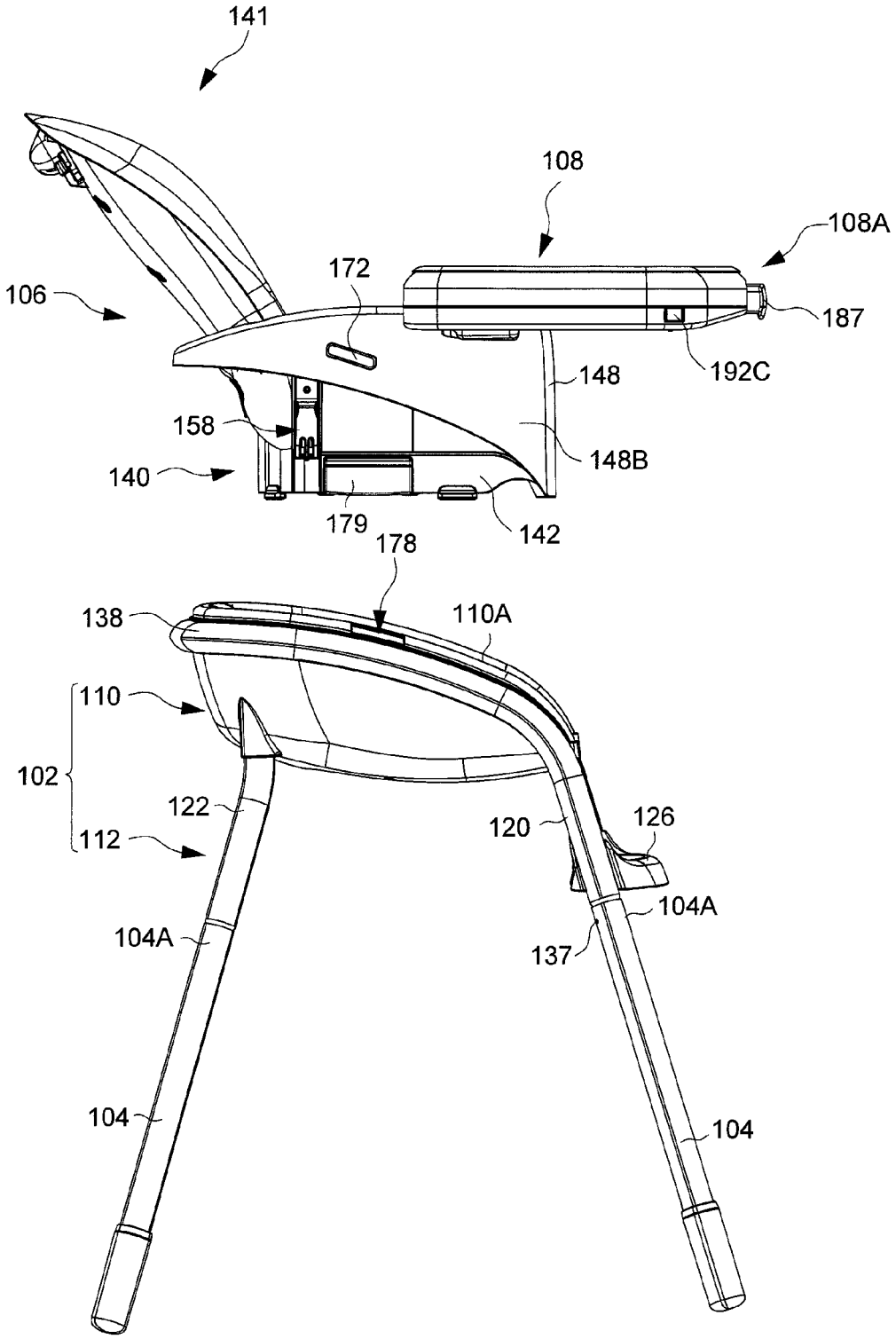
FIG. 3 is a schematic view illustrating the highchair assembly of FIG. 1 with a booster seat detached therefrom.

FIGS. 1-3 are schematic views illustrating an embodiment of a highchair assembly 100. The highchair assembly 100 can include a seat frame 102, a plurality of leg extensions 104, a booster seat 106 and a tray 108. The seat frame 102, leg extensions 104, booster seat 106 and tray 108 can be assembled together to form a highchair. The highchair configuration as shown in FIG. 1 can be suitable for receiving a young child, who can sit in the sitting area defined by the booster seat 106. As shown in FIG. 3, the booster seat 106 can be provided as a detachable seat, which can be removed according to the needs.

Figure 4:
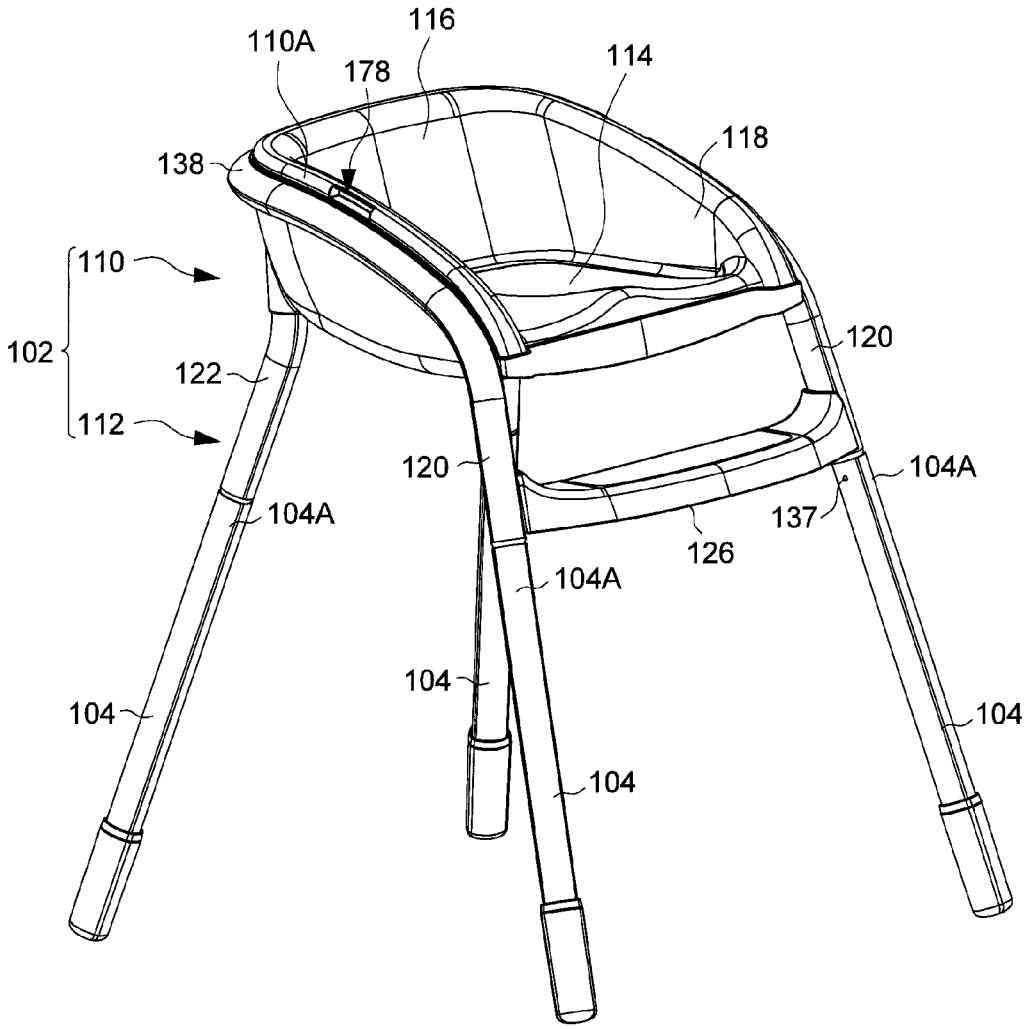
FIG. 4 is a schematic view illustrating another configuration of the highchair assembly without the booster seat installed thereon.

FIG. 4 is a schematic view illustrating another configuration of the highchair assembly without the booster seat 106 installed thereon. In this configuration, the leg extensions 104 are attached to the seat frame 102 to form a highchair. Unlike the highchair configuration of FIG. 1, the sitting area of the highchair configuration shown in FIG. 4 is defined by the seat frame 102, and is a larger than the sitting area of the booster seat 106. Accordingly, the highchair configuration shown in FIG. 4 may be suitable for seating an older child.

Figure 5:
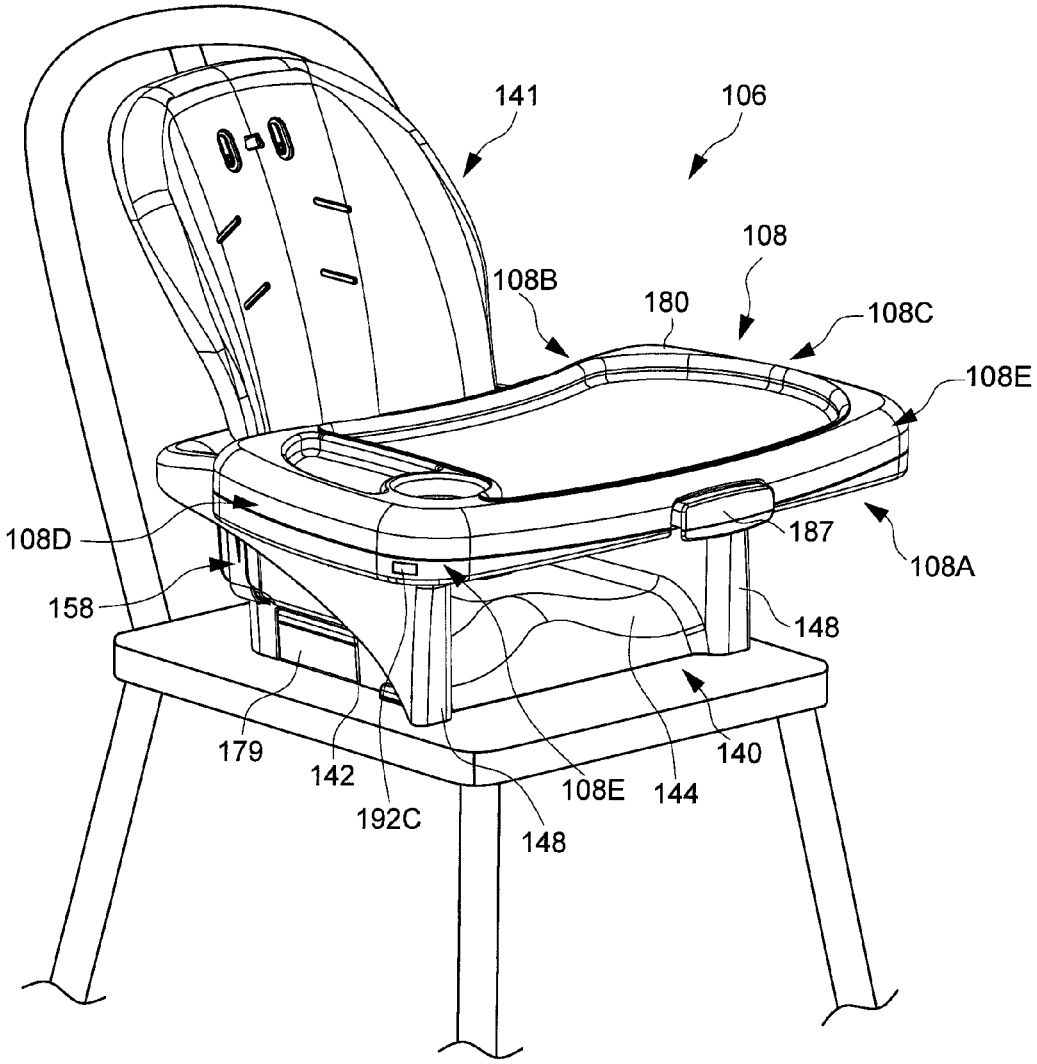
FIG. 5 is a schematic view illustrating an independent use of the booster seat with a removable tray installed thereon.
Figure 6:
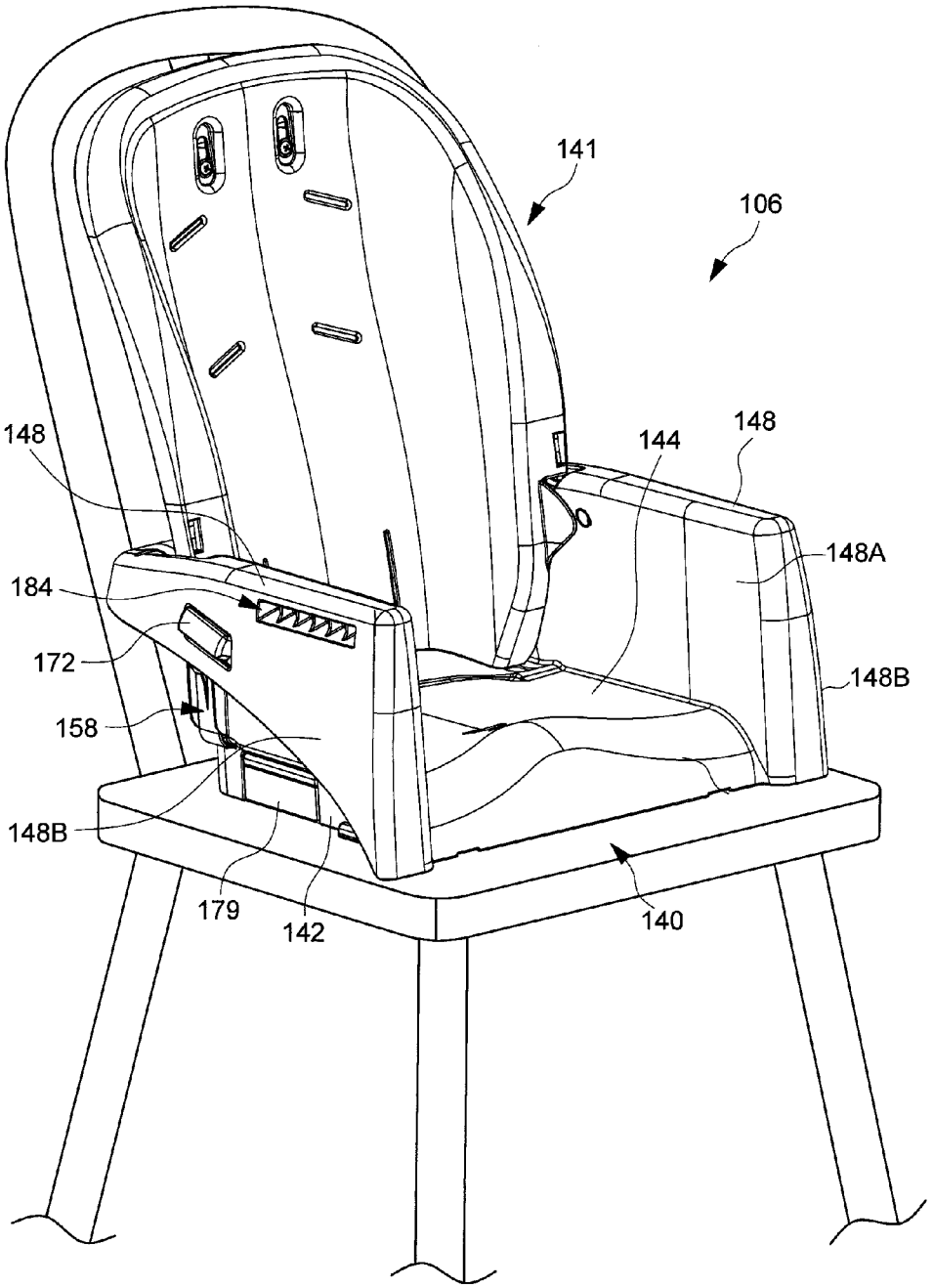
FIG. 6 is a schematic view illustrating an independent use of the booster seat without the tray.
Figure 7:
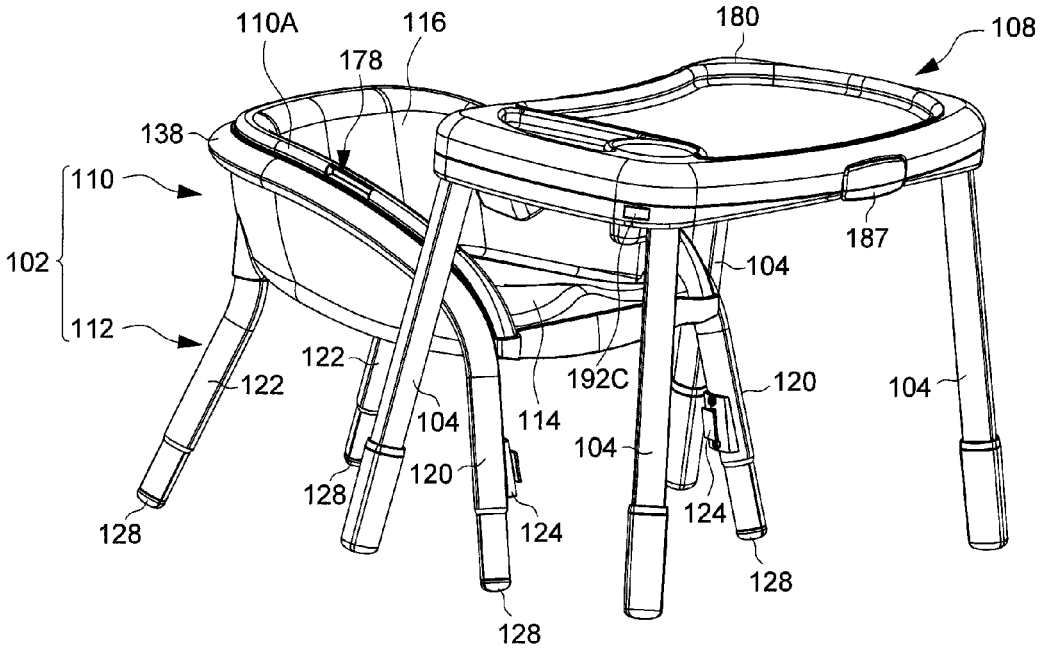
FIG. 7 is a is a schematic view illustrating another configuration in which the tray is configured as a standalone table and a seat frame of the highchair assembly is configured as a standalone chair.

FIGS. 5-7 are schematic views illustrating other configurations of use that may be set with the seat frame 102, leg extensions 104, booster seat 106 and tray 108.

FIGS. 5 and 6 are schematic views illustrating a configuration in which the booster seat 106 can be independently used on an adult chair. Referring to FIG. 5, when it is removed from seat frame 102, the booster seat 106 with the tray 108 mounted thereon can be placed on an adult chair for use as an infant feeding booster seat. As shown in FIG. 6, the tray 108 may be removed from the booster seat 106 so as to leave more room for receiving a taller child on the booster seat 106.

FIG. 7 is a schematic view illustrating another configuration in which the seat frame 102 and the tray 108 are respectively converted to a standalone chair and a standalone table. In this configuration, the tray 108 is detached from the booster seat 106, and the leg extensions 104 are removed from the seat frame 102 and attached to the tray 108. The coupling of the tray 108 with the leg extensions 104 can form a standalone table. Moreover, the seat frame 102 without the leg extensions 104 attached thereto can be used as a standalone chair having multiple legs 120 and 122 capable of standing independently on a floor surface. The height of the seat frame 102 configured as a standalone chair, and the height of the table formed by the assembly of the tray 108 and the leg extensions 104 are respectively smaller than the height of the highchair configurations shown in FIGS. 1 and 4. Accordingly, the chair and table configuration shown in FIG. 7 can be easily accessible to a child for play and entertainment.

Detailed construction of the seat frame 102, leg extensions 104, booster seat 106 and tray 108 is described hereinafter with reference to FIGS. 8-20.

Figure 8:
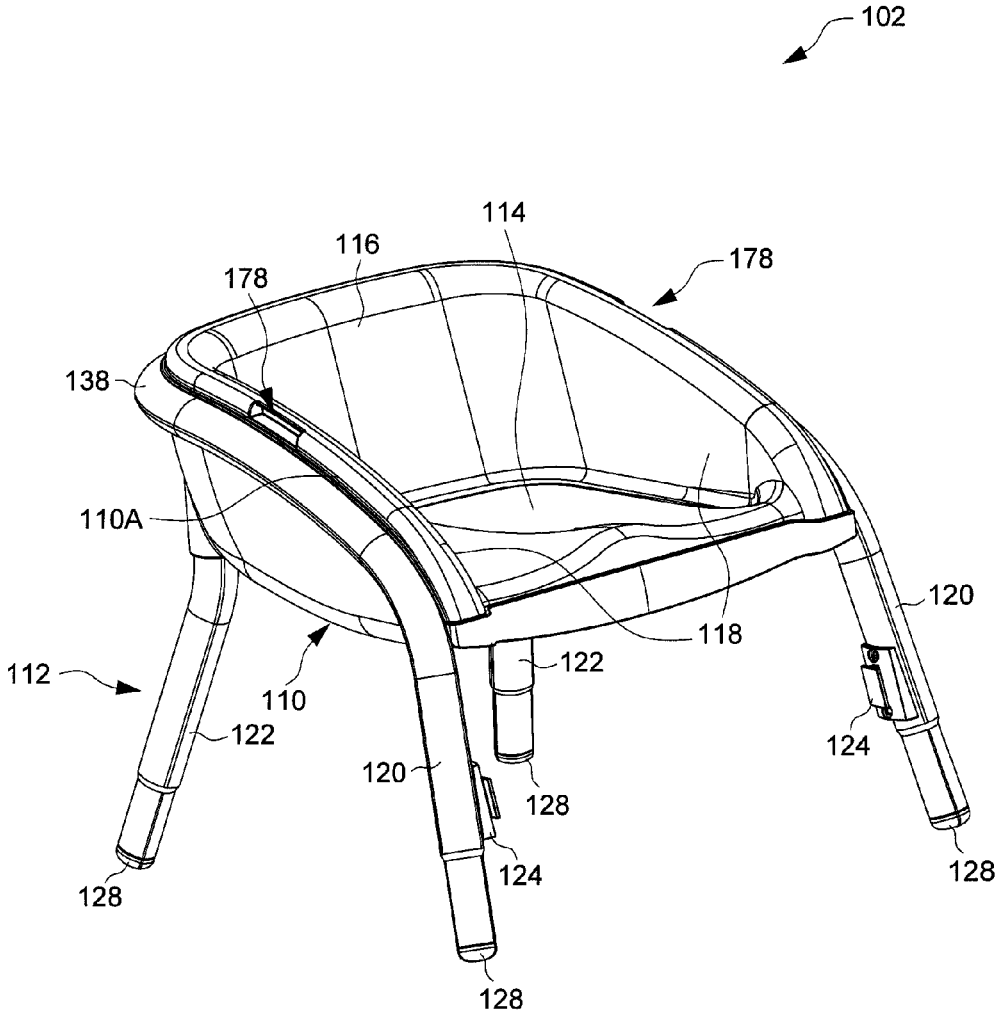
FIG. 8 is a schematic view illustrating the seat frame of the highchair assembly alone.

In conjunction with FIG. 1, FIG. 8 is a schematic view illustrating the seat frame 102 alone. The seat frame 102 can include a seat portion 110 and a support frame portion 112 affixed with each other. The seat portion 110 can have a seating surface 114 for receiving a child, a seatback 116, and a left and a right sidewall 118. The seatback 116 and the sidewalls 118 can respectively project upward from the seating surface 114 to define at least partially a sitting area of the seat portion 110. In some embodiments, the seat portion 110 including the seatback 116 and the sidewalls 118 may be formed as an integral body made of molded plastics.

The support frame portion 112 can include a plurality of legs 120 and 122 projecting downward from the seat portion 110. The legs 120 and 122 can be exemplary formed tubular segments, e.g., made of a metallic material. The legs 120 can be front legs, and the legs 122 can be rear legs. Two brackets 124 can be respectively affixed with the legs 120 below the seat portion 110. A removable footrest 126 (better shown in FIGS. 1-4) can be attached to the brackets 124 when the seat frame 102 is used in a highchair configuration. When the seat frame 102 is used as a standalone chair, the footrest 126 can be removed, and the legs 120 and 122 can provide independent standing support on a floor surface.

Figure 9:
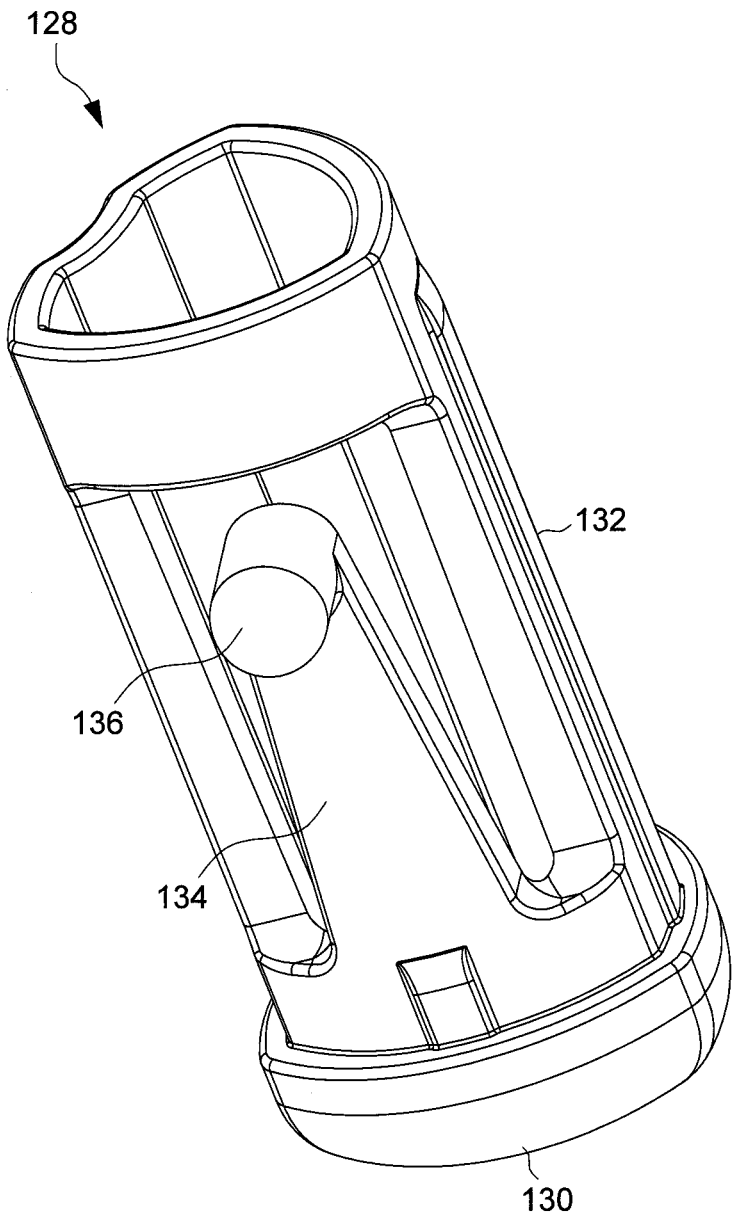
FIG. 9 is a schematic view illustrating the construction of a foot member of the seat frame.

Referring to FIG. 8, the legs 120 and 122 can have lower ends respectively affixed with foot members 128. The foot members 128 can have a similar structure. FIG. 9 is a schematic view illustrating the construction of one foot member 128. The foot member 128 can be a plastic part having a pad 130 and an insert portion 132 connected with each other. In one embodiment, the foot member 128 including the pad 130 and the insert portion 132 may be formed as an integral body by plastic molding. When the seat frame 102 is configured as a standalone chair, the legs 120 and 122 can stand on a floor surface with the pads 130 of the foot members 128 in contact against the floor surface. The insert portion 132 can be connected with a resilient tongue 134 having a distal end provided with a knob 136. When the foot member 128 is assembled with one leg 120 or 122, the insert portion 132 can be fixedly fitted into the hollow interior of the leg 120 or 122 with the pad 130 exposed outward. Moreover, the resilient tongue 134 can be received inside the leg 120 or 122, and the knob 136 can protrude outward through a hole formed through the leg 120 or 122 for locking engagement with one leg extension 104. The resilient tongue 134 can act as a latching member for locking one leg extension 104 with the leg 120 or 122.

Referring again to FIGS. 1-3, the leg extensions 104 can respectively attach to the legs 120 and 122 of the support frame portion 112 for configuring a highchair. Each of the leg extensions 104 can be an elongated tube segment having a connecting end 104A provided with a hole 137. The length of each leg extension 104 may be greater than that of the legs 120 and 122.

Referring to FIGS. 1, 8 and 9, when the leg extensions 104 are attached to the legs 120 and 122 of the support frame portion 112, the pads 130 of the foot members 128 can be respectively received in the connecting ends 104A of the leg extensions 104, and the knobs 136 of the resilient tongues 134 can respectively engage with the holes 137 on the connecting ends 104A of the leg extensions 104. The legs 120 and 122 and the leg extensions 104 attached thereto can exhibit an overall smooth profile, and the pads 130 of the foot members 128 can be substantially concealed inside the leg extensions 104 for preventing protruding features that may be undesirable in use.

For removing the leg extensions 104 from the support frame portion 112, the knobs 136 can be pushed inward to disengage from the holes 137 of the leg extensions 104. The leg extensions 104 can be thereby unlocked, and removed from the legs 120 and 122.

Referring again to FIG. 8, the seat portion 110 can further be affixed with a beam 138. In one embodiment, the beam 138 can be exemplary formed as a tubular segment, e.g., made of a metallic material. The beam 138 can extend continuously along a rear and a left and a right side of the seat portion 110. More specifically, the beam 138 can extend along the respective outer surfaces of the seatback 116 and sidewalls 118, and can slope downward toward a front of the seat portion 110 at the left and right sides thereof. The seat portion 110 can have a region 110A extending above the beam 138 at the rear, left and right sides thereof. In one embodiment, the beam 138 may be joined with the legs 120. The beam 138 can define a support surface for the booster seat 106 when it is installed on the seat frame 102.

Figure 10:
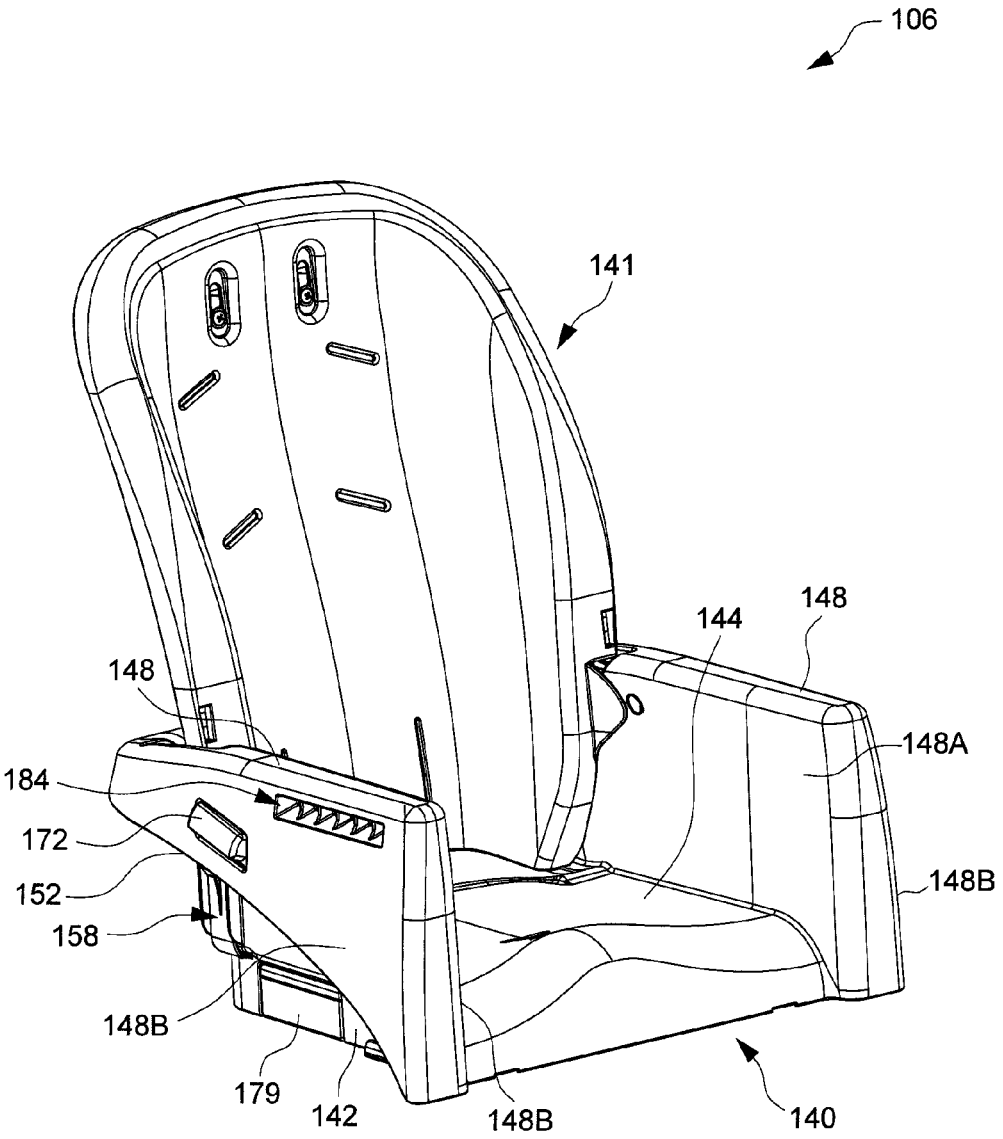
FIG. 10 is a perspective view illustrating the booster seat alone including a seat portion and a backrest assembled with each other.
Figure 11:
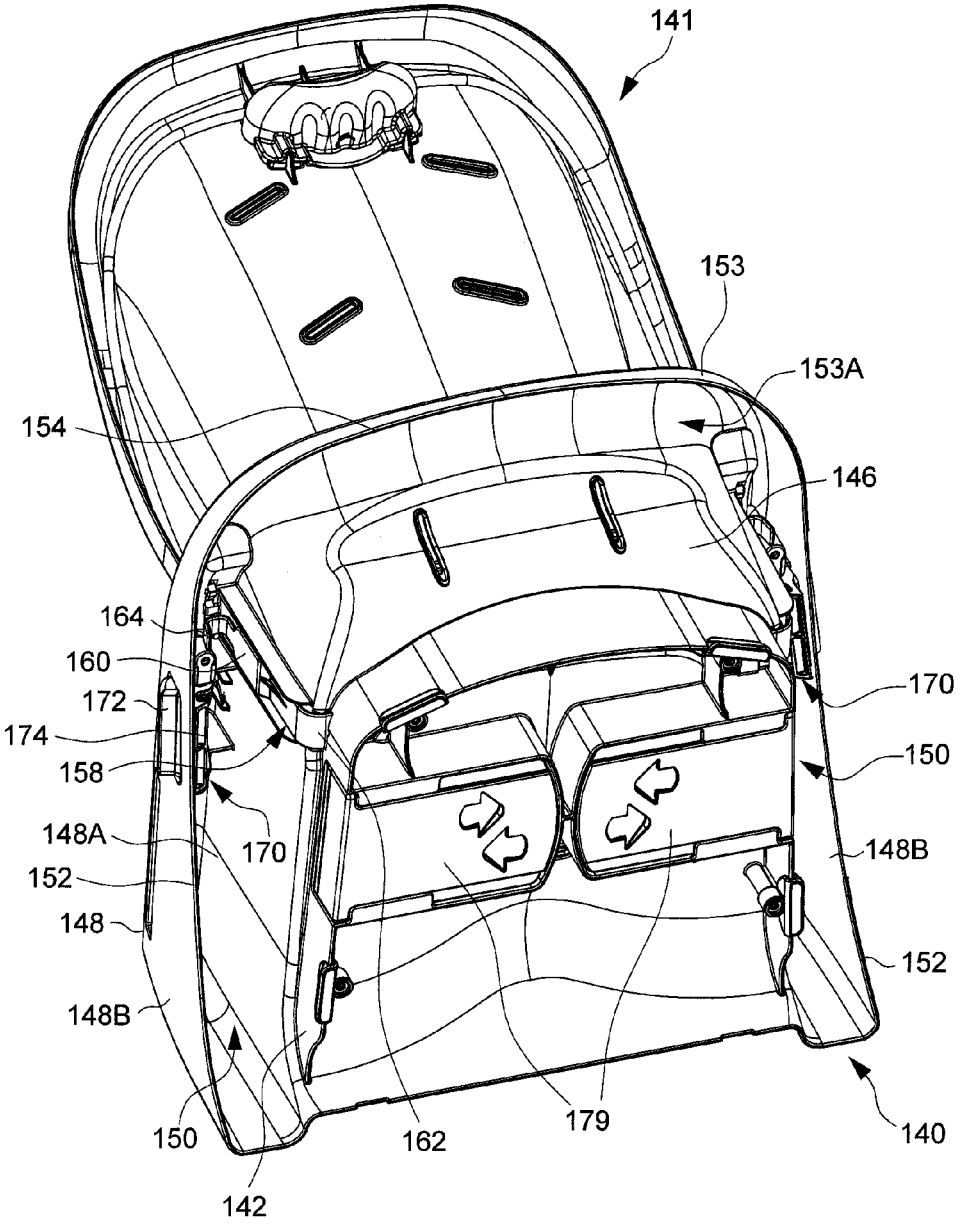
FIG. 11 is a perspective bottom view of the booster seat.
Figure 12:
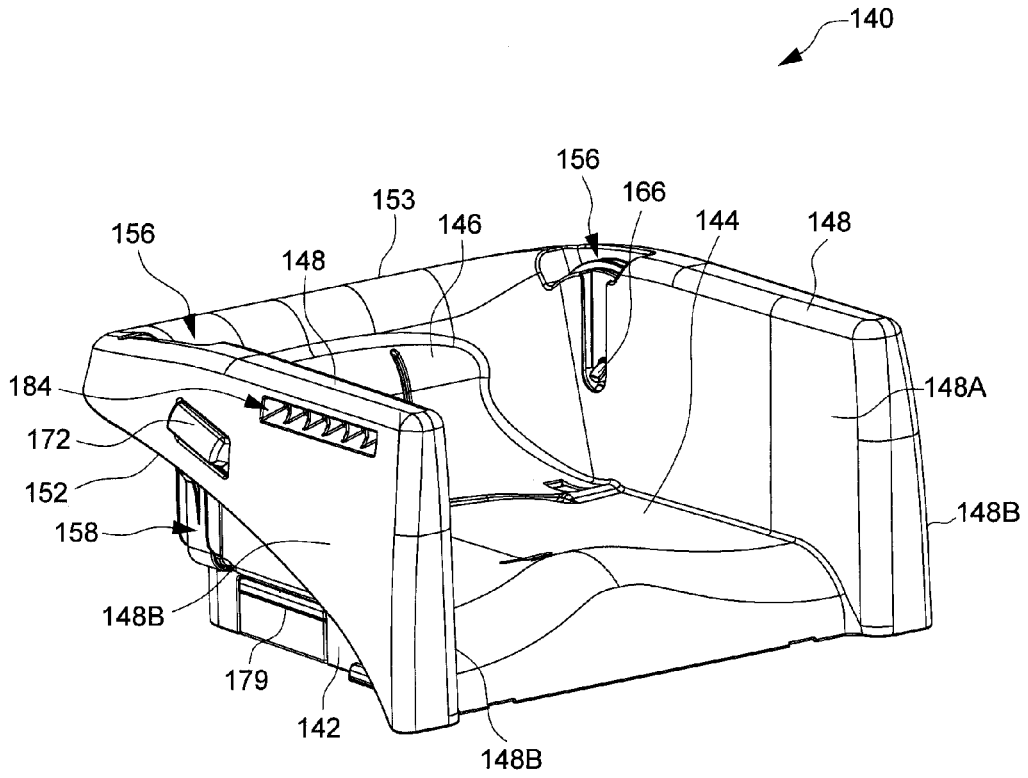
FIG. 12 is a perspective view illustrating the seat portion of the booster seat.
Figure 13:
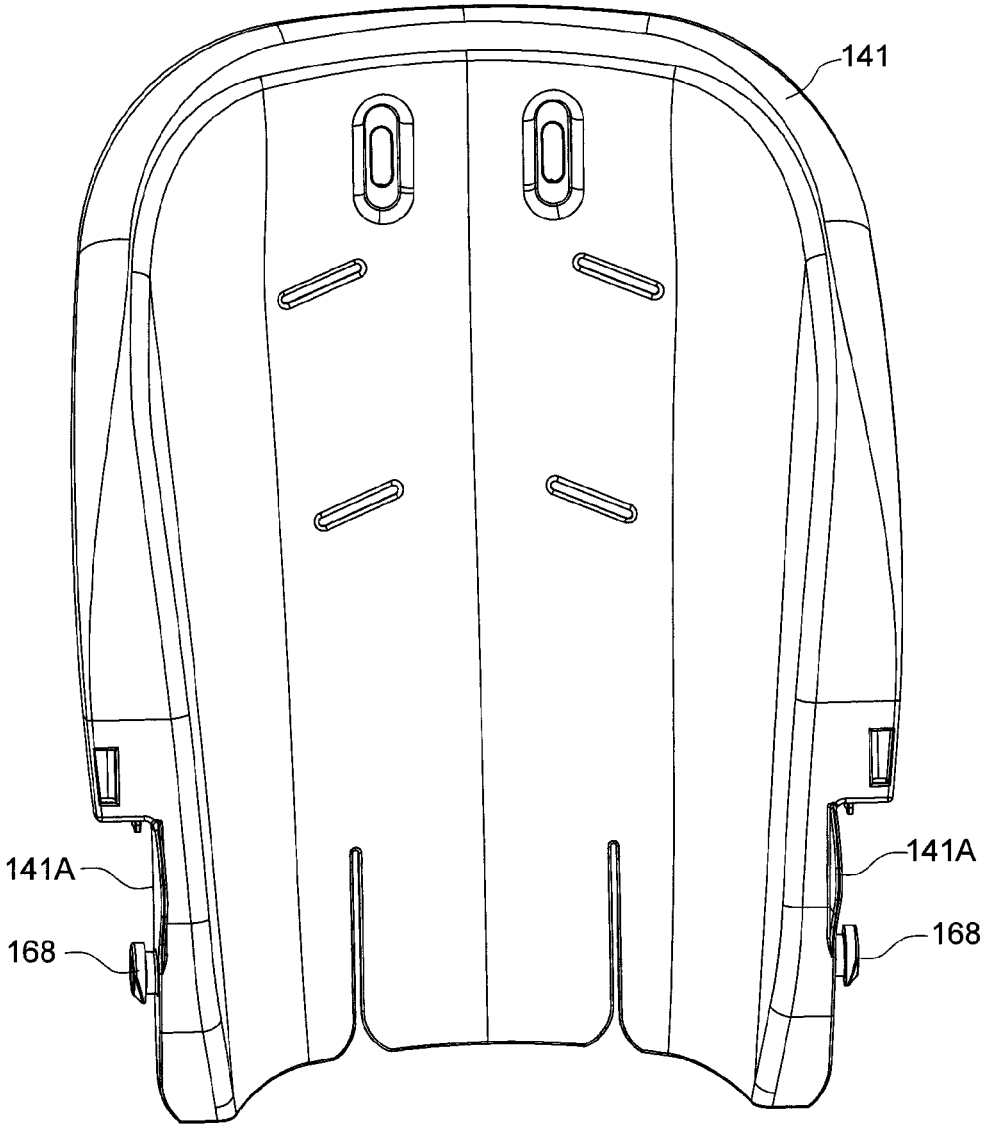
FIG. 13 is a schematic view illustrating the backrest of the booster seat.

In conjunction with FIG. 1, FIGS. 10-13 are schematic views illustrating the construction of the booster seat 106. The booster seat 106 can include a seat portion 140 and a removable backrest 141. FIGS. 10 and 11 show the seat portion 140 and the backrest 141 assembled with each other, FIG. 12 shows the seat portion 140 alone, and FIG. 13 shows the backrest 141 alone. The seat portion 140 can have a bottom portion 142 protruding downward that can provide independent standing support on a floor surface or an adult chair. The seat portion 140 can further have an upper seating surface 144 for receiving a child, a rear wall 146 and a left and a right armrest 148. The seating surface 144 can have a sitting area that is smaller than that of the seat portion 110 of the seat frame 102. The rear wall 146 and the armrests 148 can respectively project upward from the seating surface 144. In one embodiment, the seat portion 140 including the rear wall 146 and the armrests 148 may be formed as a unitary body made of molded plastics.

Each of the armrests 148 can have an inner cavity 150 that is opened downwardly and is delimited at least partially between an inner sidewall 148A and an outer sidewall 148B of the armrest 148. The inner sidewall 148A is adjacent to the seating surface 144, and the outer sidewall 148B is located at the outer side of the armrest 148. The outer sidewall 148B can have a lower edge 152 that rises obliquely toward a rear of the seat portion 140 and lowers toward a front of the seat portion 140. A top of the rear wall 146 can be connected with a bend portion 153 that extends along a width of the seat portion 140. The bend portion 153 can at least partially define an inner cavity 153A that is opened downwardly and respectively connects with the inner cavities 150 of the two armrests 148. Moreover, the bend portion 153 can have a lower edge 154 that is connected with the lower edges 152 of the two armrests 148.

As better shown in FIG. 12, the seat portion 140 can further include two mount slots 156 for assembling the backrest 141. The two mount slots 156 can be respectively formed in the armrests 148 (e.g., in the inner sidewall 148A thereof) near the rear wall 146. In one embodiment, each of the mount slots 156 can have a T-shape. Moreover, the seat portion 140 can be assembled with two latching members 158 that are respectively disposed adjacent to the two mount slots 156. The two latching members 158 are operable to engage with the backrest 141 for locking the backrest 141 with the seat portion 140, and to disengage from the backrest 141 for allowing its removal.

In conjunction with FIGS. 10-13, FIG. 14 is a cross-sectional view illustrating the backrest 141 locked with the seat portion 140 via the latching member 158. The two latching members 158 can be similar in construction, each of which can include an elongated segment 160, a bend portion 162 and an actuating portion 164. The bend portion 162 and the actuating portion 164 can be respectively connected with the elongated segment 160 at two opposite sides thereof. The bend portion 162 can extend generally perpendicular to the elongated segment 160, and the actuating portion 164 can have a curved shape for facilitating its operating with a finger. Moreover, a region of the elongated segment 160 between the bend portion 162 and the actuating portion 164 can be formed with a knob 166 having an angled surface 166A. In one embodiment, the latching member 158, including the bend portion 162, actuating portion 164 and knob 166 may be integrally formed as a single part. The bend portion 162 can be fixedly connected with an interior of the seat portion 140, and the knob 166 can protrude into an interior of the mount slot 156 associated therewith. The elongated segment 160 can elastically deflect relative to the bend portion 162 to cause the knob 166 to engage or disengage the backrest 141.

Figure 14:
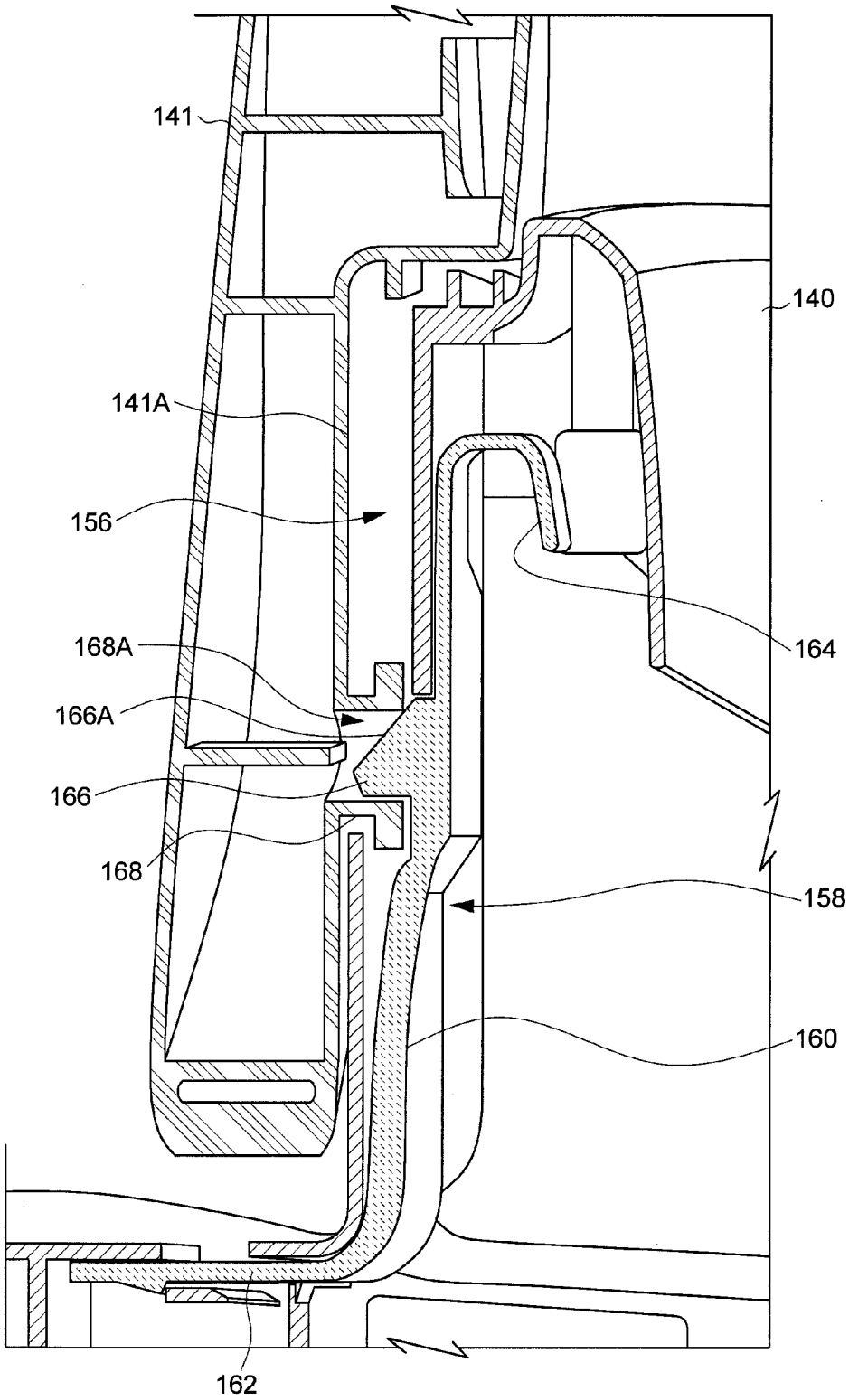
FIG. 14 is a cross-sectional view illustrating how the backrest is locked with the seat portion in the booster seat.

Referring to FIGS. 13 and 14, the backrest 144 can have two protruding bosses 168 respectively protruding outward at a left and a right side edge 141A of the backrest 141 near a lower end thereof. Each boss 168 can have a T-shape, and can be provided with an opening 168A.

When the backrest 141 is assembled with the seat portion 140, the two bosses 168 can be respectively inserted into the mount slots 156. As they slide into the mount slots 156, the bosses 168 can respectively push against the angled surfaces 166A of the knobs 166, which causes respective deflection of the elongated segments 160 of the latches 158 away from the side edges 141A of the backrest 141 to allow further downward travel of the bosses 168. Once the bosses 168 are fully inserted in the mount slots 156, the elongated segments 160 can elastically deflect toward the side edges 141A of the backrest 141 to cause the knobs 166 to respectively engage with the openings 168A of the bosses 168. The latches 158 can thereby block upward displacement of the backrest 141, and the backrest 141 can be locked with the seat portion 140.

For removing the backrest 141, the actuating portion 164 can be pulled outward to cause deflection of the elongated segment 160 and disengage the knob 166 from the corresponding boss 168. Once the two latches 158 are disengaged, the unlocked backrest 141 can be removed from the seat portion 140.

Figure 15:
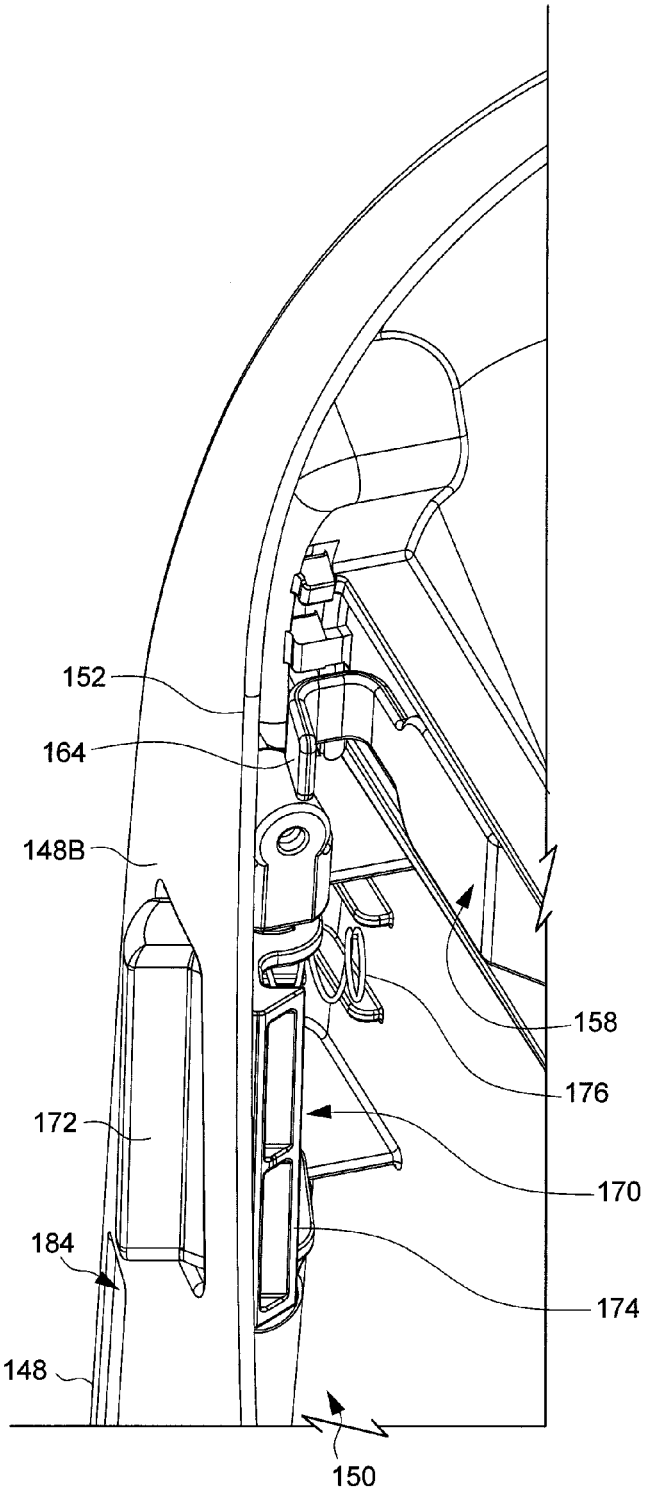
FIG. 15 is an enlarged view illustrating the assembly of a latch with a armrest of the booster seat, the latch being used for locking the booster seat with the seat frame of the highchair assembly.

Referring to FIG. 11, the booster seat 106 can further include two anchoring latches 170 respectively operable to engage with the seat portion 110 of the seat frame 102 when the booster seat 106 is installed on the seat frame 102. The two anchoring latches 170 can be respectively assembled with the two armrests 148, and can respectively extend into the inner cavities 150 thereof. The two anchoring latches 170 can have a same construction, and can be respectively connected pivotally with the seat portion 140 of the booster seat 106. In conjunction with FIG. 11, FIG. 15 is an enlarged view illustrating the assembly of one latch 170 with one armrest 148. The latch 170 can have an actuating portion 172 and a latching portion 174. In one embodiment, the anchoring latch 170 including the actuating portion 172 and the latching portion 174 can be formed integrally as a single part. The actuating potion 172 can be exposed outward through the outer sidewall 148B of the armrest 148, and the latching portion 174 can protrude into the inner cavity 150 of the armrest 148. Moreover, a spring 176 can be respectively connected with the anchoring latch 170 and a fixed point of the seat portion 140. The spring 176 can bias the anchoring latch 170 to a locking state for engagement of the latching portion 174 with the seat portion 110 of the seat frame 102.

As better shown in FIGS. 4 and 8, the seat portion 110 of the seat frame 102 can have two slots 178 respectively formed on the left and right sides of the region 110A above the beam 138 for receiving the locking engagement of the anchoring latches 170.

When the booster seat 106 is installed on the seat portion 110 of the seat frame 102, the armrests 148 and the bend portion 153 of the seat portion 140 can respectively rest in contact with the beam 138, and the region 110A of the seat portion 110 can be received in the inner cavities 150 of the two armrests 148 and the inner cavity 153A of the bend portion 153. The booster seat 106 can be thereby supported at least partially by the beam 138, and lateral and back and forth displacements of the booster seat 106 relative to the seat frame 102 can be prevented. Moreover, the two anchoring latches 170 can respectively engage with the two slots 178 under the biasing action of the springs 176 to lock the booster seat 106 in place. For removing the booster seat 106, the actuating portions 172 can be respectively depressed to disengage the anchoring latches 170 from the slots 178. The unlocked booster seat 106 then can be removed from the seat frame 102.

As better shown in FIG. 11, the booster seat 106 can further include two storage drawers 179 for receiving at least partially a restraint harness (not shown) of the booster seat 106. The storage drawers 179 can be assembled with the bottom portion 142 of the seat portion 140. The restraint harness received in the storage drawers 179 may be deployed for attaching the booster seat 106 on an adult chair.

Figure 16:
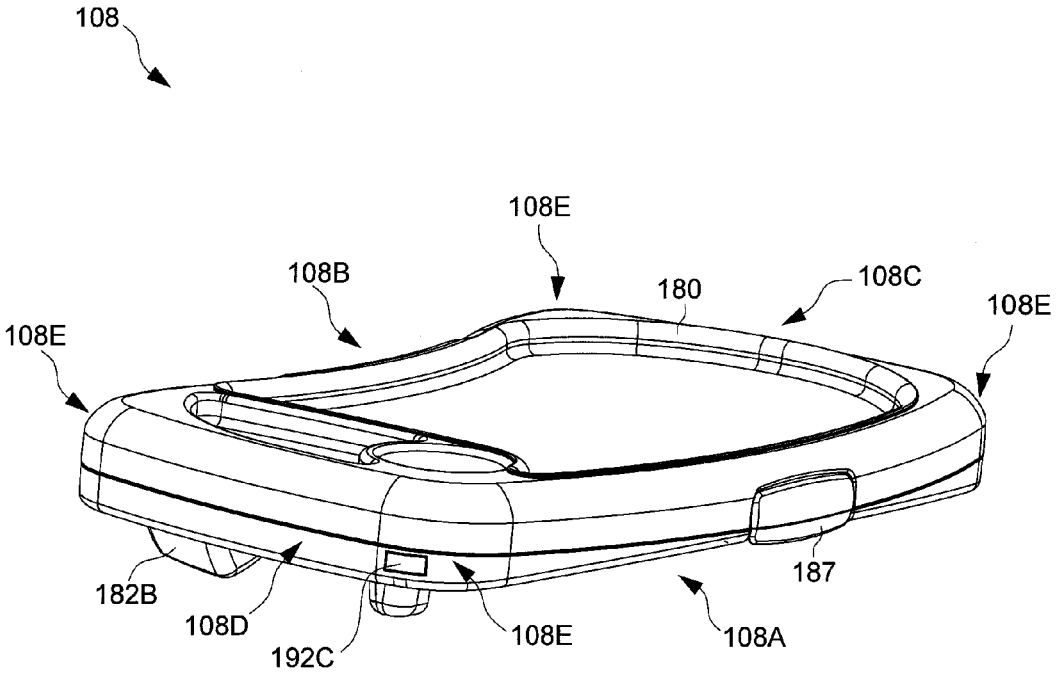
FIG. 16 is a perspective view illustrating a removable tray attachable to the booster seat of the highchair assembly.
Figure 17:
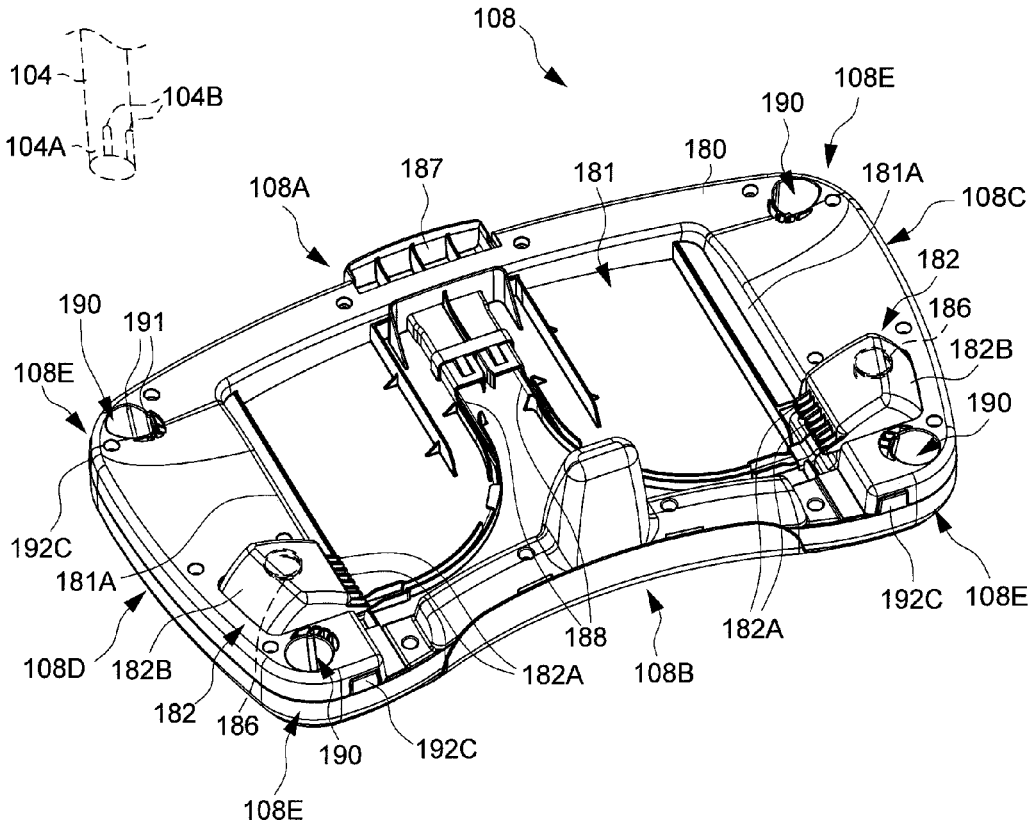
FIG. 17 is a perspective view illustrating an underside of the tray.

In conjunction with FIG. 1, FIGS. 16 and 17 are schematic views illustrating the tray 108. The tray 108 is detachably installable on the armrests 148 of the booster seat 106 over the seating surface 144 of the seat portion 140. The tray 108 can include a rigid tray body 180 adapted for receiving items such as drinking bottles, bowls, dishes, etc. In one embodiment, the tray body 180 may be formed by the assembly of one or more casings, e.g., an upper and a lower casing.

The tray body 180 can define a front side 108A, a rear side 108B, a left and a right side 108C and 108D, and multiple corners 108E (e.g., 4 corners 180E) of the tray 108. The front and rear sides 108A and 108B respectively join with the left and right sides 108C and 108D at the corners 108E. The rear side 108B of the tray 108 is close to a child sitting on the booster seat 106 when the tray 108 is installed thereon.

The tray body 180 can be assembled with two latches 182 (better shown in FIG. 17) for locking the tray 108 with the booster seat 106. More specifically, an underside of the tray body 180 can have a cavity 181 delimited transversally between a left and a right sidewall 181A, and the two latches 182 can be respectively disposed adjacent to the left and right sidewalls 181A near the rear side 108B of the tray 108. In one embodiment, the latches 182 may be pivotally assembled with the tray body 180. Each latch 182 can have a plurality of teeth 182A projecting into the cavity 181, and an actuating portion 182B that is affixed with the teeth 182A and exposed at the underside of the tray 108. In one embodiment, the latch 182 including the teeth 182A and the actuating portion 182B can be formed integrally as a single part. When the tray 108 is installed on the booster seat 106, a top of the armrests 148 of the booster seat 106 can be respectively received in the cavity 181 respectively adjacent to the left and right sidewalls 181A. The teeth 182A of each latch 182 can engage with a locking slot 184 (better shown in FIG. 10) provided on the outer sidewall 148B of the corresponding armrest 148 to lock the tray 108 with the booster seat 106. The locking slot 184 can have a plurality of indentations for engagements of the teeth 182A. Each latch 182 can be respectively biased by a spring 186 (shown with phantom lines in FIG. 17) toward a locking state where the teeth 182A engage with the locking slot 184. Moreover, each actuating portion 182B may be independently operable to cause unlocking displacement of the corresponding latch 182 for disengaging the teeth 182A from the locking slot 184 of the booster seat 106.

Figure 20:
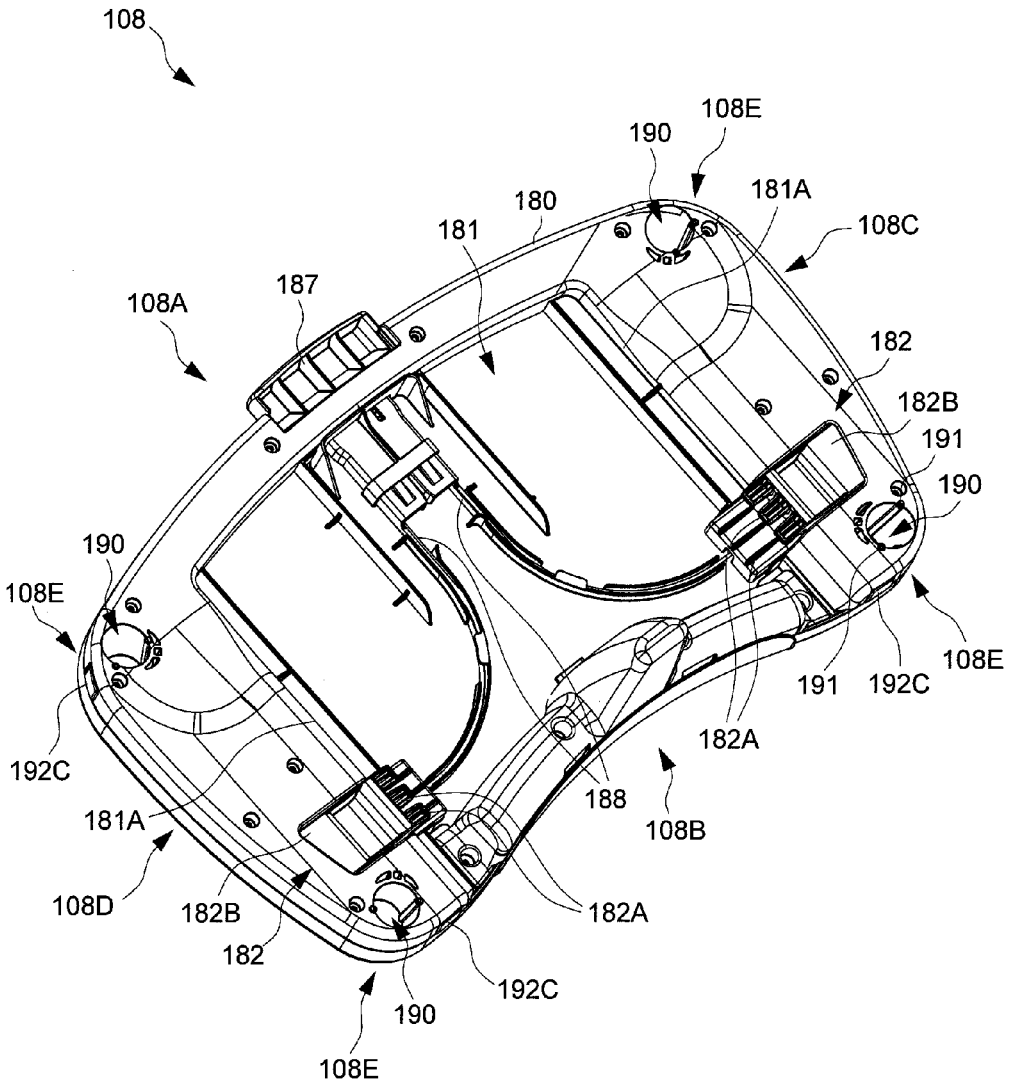
FIG. 20 is a schematic view illustrating another example of assembling a plurality of latches in the tray, the latches being used for locking the tray on a booster seat.

Rather than the pivotal connection described above, another embodiment may have the latches 182 slidably assembled with the tray body 180, which is schematically shown in FIG. 20. In this case, the latches 182 can respectively slide along a transversal direction (i.e., extending from the left side 108C to the right side 108D of the tray 108) to lock and unlock the tray 108 with respect to the booster seat 106.

To facilitate unlocking operation of the latches 182, the tray 108 may further include a release member 187 that is coupled with the two latches 182 and can be operable to drive concurrent unlocking displacements of the two latches 182. For example, the release member 187 can be slidably assembled with the tray body 180 at the front side 108A, and can be respectively coupled with the two latches 182 via two linkage arms 188. The two linkage arms 188 may be made of an elastically deformable material, and can be curved to respectively extend toward the left and right sides 108C and 108D of the tray 108. Each linkage arm 188 can have two ends respectively connected with a corresponding latch 182 and the release member 187. When it is pulled outward, the release member 187 can drive sliding displacements of the linkage arms 188, which in turn cause the latches 182 to move (e.g., rotation or sliding displacement) for respectively disengaging from the armrests 148 of the booster seat 106.

Figure 18:
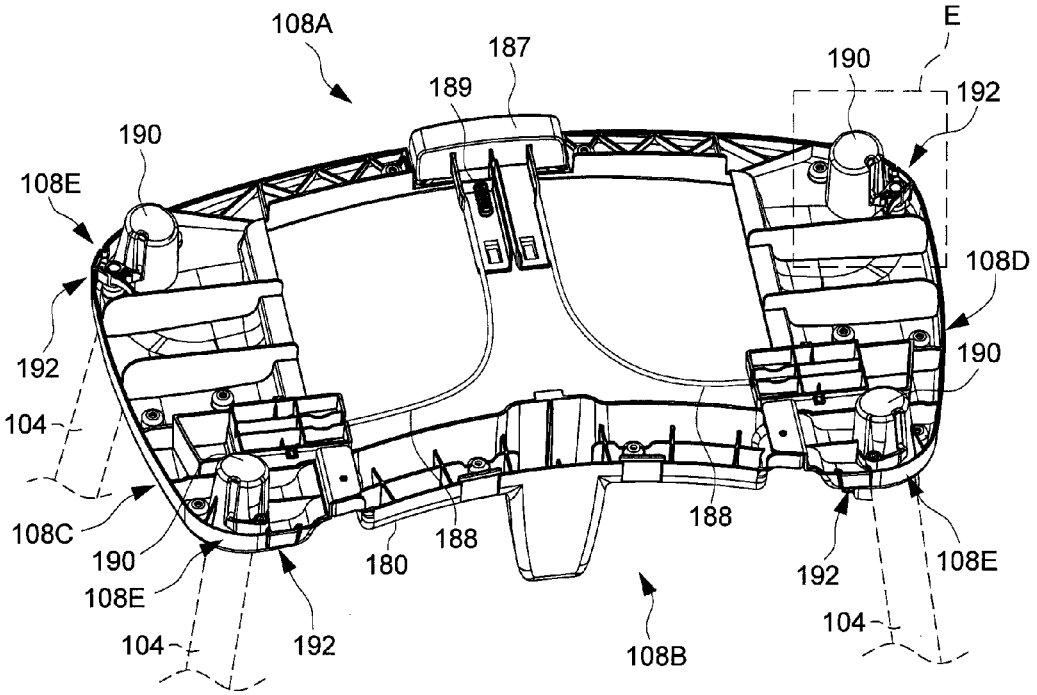
FIG. 18 is a schematic view illustrating an inner construction of the tray including a plurality of latches for locking leg extensions with the tray.

As better shown in FIG. 18, the release member 187 can be further connected with a spring 189. The spring 189 can bias the release member 187 toward the interior of the tray body 180 to an initial position corresponding to a locking state of the latches 182.

Referring to FIGS. 16 and 17, the tray 108 can further include a plurality of sockets 190 configured to receive the insertion of the leg extensions 104. The sockets 190 can be affixed with the tray body 180 at locations respectively near the corners 180E of the tray 108. Each socket 190 can include a pocket in which the connecting end 104A of one leg extension 104 can be inserted for attachment. The pocket of the socket 190 can be formed in the tray body 180, and opened at the underside of the tray body 180. Moreover, an inner sidewall of the pocket can include one or more ribs 191. When one leg extension 104 is inserted into the socket 190 (for clarity only one leg extension 104 is exemplary shown in FIG. 17 with phantom lines), the ribs 191 can respectively engage recesses 104B provided on an outer surface of the connecting end 104A of the leg extension 104 to assist in properly orienting the leg extension 104 and prevent its rotation in the socket 190. It will be appreciated that alternate embodiments may place the ribs 191 on the leg extension 104, and the recesses 104B on the inner sidewall of the socket 190.

Figure 19:
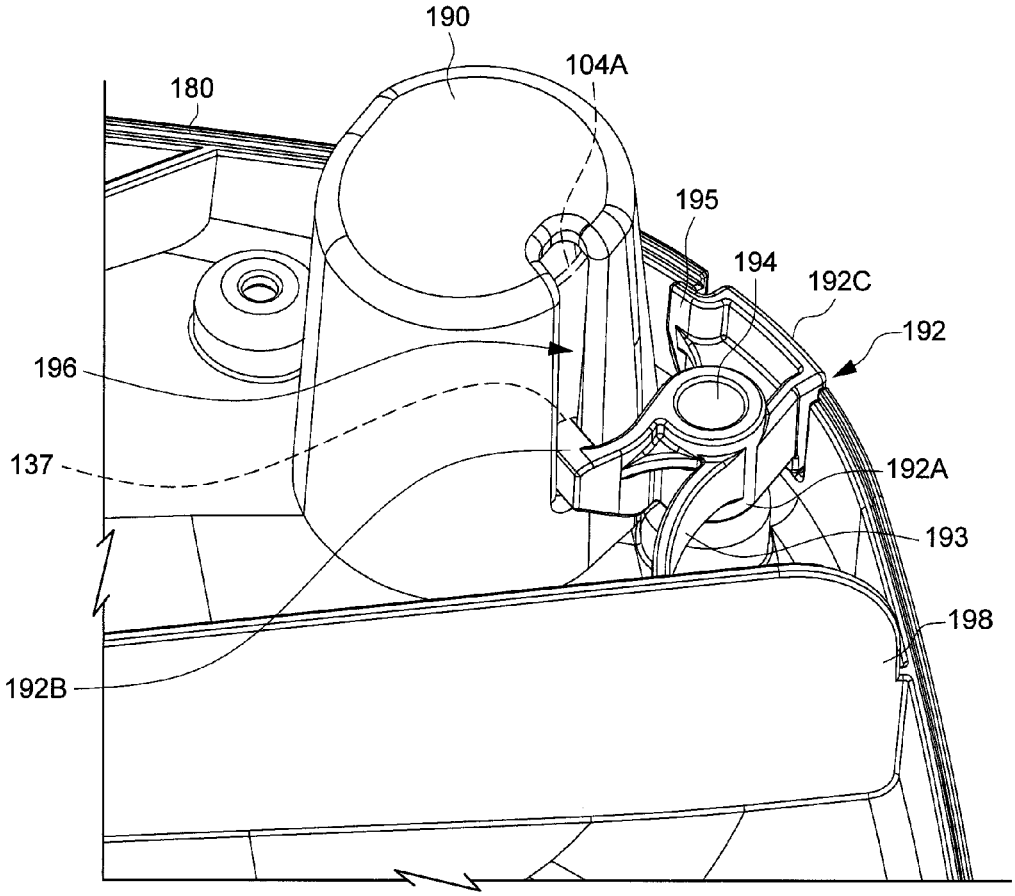
FIG. 19 is an enlarged view of portion E shown in FIG. 18.

In conjunction with FIGS. 16 and 17, FIG. 18 is a schematic view illustrating further construction details of the tray 108, and FIG. 19 is an enlarged view of portion E shown in FIG. 18. Referring to FIGS. 18 and 19, each socket 190 can be respectively associated with a latch 192 operable to engage with the connecting end 104A of the leg extension 104 for locking the leg extensions 104 with the tray 108. The latches 192 can have a similar construction. Each latch 192 can include a sleeve 192A, a locking arm 192B and a release button 192C, which are all affixed together as a unitary part. In one embodiment, the latch 192 including the sleeve 192A, locking arm 192B and release button 192C may be formed as an integral part. The sleeve 192A, locking arm 192B and release button 192C can protrude from the sleeve 192A in different directions. Moreover, the latch 192 can be connected with a resilient member 193, which is operable to bias the latch 192 toward a locking state. In one embodiment, the resilient member 193 may be formed integrally with the latch 192, so that the latch 192 and the resilient member 193 may be provided as a single part.

All of the latches 192 can be assembled with the tray body 180 in a same way. A post 194 affixed to the tray body 180 can be disposed through the sleeve 192A to pivotally connect the latch 192 with the tray body 180 adjacent to one corresponding socket 190. The post 194 can extend along a direction substantially perpendicular to a major support surface of the tray body 180, so that the rotation axis of the latch 192 can be substantially perpendicular to the major support surface of the tray body 180. An end of the locking arm 192B can extend into the pocket of the socket 190 via a slot 196 formed through an inner sidewall of the socket 190. The release button 192C can be exposed outward through an opening of the tray body 180 for operation. The resilient member 193 can have a distal end anchored with a sidewall 198 affixed to the tray body 180.

When the connecting end 104 of the leg extension 104 is inserted in the socket 190, the latch 192 can be rotationally biased by the resilient member 193 to a locking state in which the locking arm 192B engages through the hole 137 on the connecting end 104A of the leg extension 104 for locking the leg extension 104 with the tray 108. The spring force applied by the resilient member 193 may cause a stop lip 195 (better shown in FIG. 19) provided at a side of the release button 192C to abut against the tray body 180 at a border region of the opening where the release button 192C is exposed, which can limit the course of the latch 192 and stop it in the locking state. Moreover, the release button 192C can be depressed to cause unlocking rotation of the latch 192, which disengages the locking arm 192B from the connecting end 104A of the leg extension 104.

Exemplary operation for converting the highchair assembly 100 to various configurations of use is described hereinafter with reference to FIGS. 1-20. Referring to FIGS. 1-3, suppose that a caregiver wants to configure the highchair assembly 100 for seating a young child. The lower ends of the legs 120 and 122 of the seat frame 102 can be respectively inserted into the leg extensions 104, and the resilient tongues 134 of the foot members 128 can be respectively engage with the holes 137 on the connecting ends 104A of the leg extensions 104 for locking the leg extensions 104 with the seat frame 102. The leg extensions 104 can thereby provide standing support for the highchair assembly 100. Moreover, the booster seat 106 can be installed on the seat frame 102 such that the lower edges 152 of the armrests 148 and the lower edge 154 of the bend portion 153 respectively rest in contact on the beam 138, and the anchoring latches 170 can respectively engage with the slots 178 on the region 110A of the seat portion 110 received in the inner cavities 150 of the two armrests 148. The booster seat 106 can be thereby supported at by the beam 138 and securely locked with the seat frame 102, the booster seat 106 lying above and substantially out of contact with the seating surface 114 of the seat frame 102.

For installing the tray 108 on the booster seat 106, the tray 108 can be placed such that the top of the armrests 148 are received in the cavity 181 at the underside of the tray 108, and the latches 182 of the tray 108 can respectively engage with the armrests 148 of the booster seat 106 to lock the tray 108 with the booster seat 106.

In case the tray 108 is unused, the latches 182 can be unlocked by respectively operating the two actuating portions 182B at the left and right sides 108C and 108D of the tray 108, or by pulling the release member 187 at the front side 108A of the tray 108. As a result, the two latches 182 can move for disengaging from the armrests 148 of the booster seat 106, which can then be removed from the booster seat 106.

For converting the highchair assembly 100 from the configuration of FIG. 1 to the configuration shown in FIG. 4, the actuating portions 172 at the left and right sides of the booster seat 106 can be respectively operated to disengage the anchoring latches 170 from the seat portion 110 of the seat frame 102. The unlocked booster seat 106 then can be removed from the seat frame 102, which converts the highchair assembly 100 to the configuration shown in FIG. 4.

The booster seat 106 detached from the seat frame 102 may be used independently for seating a child on an adult chair as shown in FIGS. 5 and 6. In this configuration, the storage drawers 179 may be opened so that the restraint harness (not shown) of the booster seat 106 can be pulled out and attached with the adult chair.

For converting the highchair assembly 100 to a lower standalone chair configuration as shown in FIG. 7, the knobs 136 of the legs 120 and 122 can be depressed so as to disengage from the holes 137 of the leg extensions 104, and the unlocked leg extensions 104 then can be removed from the legs 120 and 122 of the seat frame 102. The seat frame 102 alone can thereby form an independent chair of a height smaller than that of the highchair assembly 100. The standalone chair formed by the seat frame 102 can stand independently on the legs 120 and 122, and can receive a child on the seating surface 114.

For converting the tray 108 to a standalone table configuration as shown in FIG. 7, the leg extensions 104 can be respectively inserted into the sockets 190 of the tray 108, and the latches 192 can respectively engage with the holes 137 on the connecting ends 104A of the leg extensions 104 to lock the leg extensions 104 with the tray 108. The tray 108 can be thereby configured as a standalone table capable of standing independently on the leg extensions 104. As shown in FIG. 7, the standalone table formed by the assembly of the tray 108 with the leg extensions 104 can be compatible for use with the standalone chair formed by the seat frame 102, i.e., the standalone table can be used by a child sitting on the standalone chair formed by the seat frame 102. Moreover, the standalone chair formed by the seat frame 102 may also be conveniently stowed under the tray 108 of the standalone table.

Advantages of the structures described herein include the ability to provide a highchair assembly that can be converted to different configurations according to the child's age and needs.

Realizations of the highchair assembly have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A convertible highchair assembly comprising:

a seat frame including a support frame portion and a seat portion affixed with each other, the seat portion having a first seating surface adapted to receive a child;

a booster seat installable on the seat frame and detachable from the seat frame, the booster seat having a second seating surface for receiving a child, wherein the seat portion of the seat frame is capable of receiving a child on the first seating surface when the booster seat is removed from the seat frame;

a tray detachably installable on the booster seat over the second seating surface, the tray comprising a rigid tray body having a plurality of sockets, and a plurality of latches assembled with the rigid tray body at locations respectively adjacent to the sockets, the rigid tray body being detachable from the booster seat and attachable to the booster seat over the second seating surface; and a plurality of leg extensions selectively attachable to any of the support frame portion and the tray, each of the leg extensions having a connecting end;

wherein the connecting ends of the leg extensions are attached to the support frame portion for configuring a highchair, and the connecting ends of the leg extensions are respectively inserted into the sockets and locked with the tray by the latches while the tray is removed from the booster seat for configuring a standalone table, the leg extensions providing standing support for the tray in the configuration of the standalone table.

2. The convertible highchair assembly according to claim 1, wherein the convertible highchair assembly is configured to provide sitting support for a child at a first height when the leg extensions are attached to the support frame portion, and the seat frame alone is configured as a standalone chair having a second height smaller than the first height when the leg extensions are removed from the support frame portion.

3. The convertible highchair assembly according to claim 2, wherein the support frame portion includes a plurality of legs projecting downward from the seat portion, the legs providing standing support on a floor surface when the seat frame is configured as the standalone chair.

4. The convertible highchair assembly according to claim 3, wherein the leg extensions are respectively attachable to the legs of the support frame portion.

5. The convertible highchair assembly according to claim 3, wherein the legs respectively include foot members that respectively have resilient tongues, the resilient tongues respectively engaging with holes formed on the connecting ends of the leg extensions when the leg extensions are attached to the legs.

6. The convertible highchair assembly according to claim 5, wherein the resilient tongues are respectively formed integrally with the foot members.

7. The convertible highchair assembly according to claim 5, wherein each of the foot members has a pad for resting in contact against a floor surface when the seat frame is configured as the standalone chair, the pads of the foot members being respectively located inside the leg extensions when the leg extensions are attached to the legs.

8. The convertible highchair assembly according to claim 1, further including a beam affixed with the seat portion, the beam extending along a rear and a left and a right side of the seat portion, the booster seat when installed on the seat frame resting in contact against the beam so that the booster seat is supported at least partially by the beam.

9. The convertible highchair assembly according to claim 8, wherein the beam is a tubular segment affixed with the seat portion.

10. The convertible highchair assembly according to claim 1, wherein at least one of the latches is formed integrally with a resilient portion that biases the latch toward a locking state.

11. The convertible highchair assembly according to claim 1, wherein at least one of the latches is connected with a release button exposed outward, the release button being operable to cause an unlocking displacement of the latch connected therewith.

12. The convertible highchair assembly according to claim 11, wherein the release button is adjacent to a corner of the tray.

13. The convertible highchair assembly according to claim 1, wherein at least one of the latches is pivotally connected with the rigid tray body and is formed integrally with a resilient portion and a release button, the resilient portion biasing the latch toward a locking state, and the release button being operable to cause an unlocking displacement of the latch coupled thereto.

14. The convertible highchair assembly according to claim 1, wherein the tray further includes a plurality of second latches operable to engage with the booster seat, the second latches respectively have actuating portions exposed at an underside of the tray, each of the actuating portions being independently operable for causing unlocking displacement of the second latch coupled thereto.

15. The convertible highchair assembly according to claim 14, wherein the second latches are respectively connected with a release member provided at a front side of the tray, the release member being operable to drive concurrent unlocking displacements of the second latches.

16. The convertible highchair assembly according to claim 14, wherein the second latches are pivotally or slidably assembled with the tray.

17. The convertible highchair assembly according to claim 1, wherein the booster seat includes two anchoring latches operable to engage and lock with the seat portion when the booster seat is installed on the seat frame.

18. The convertible highchair assembly according to claim 1, wherein the booster seat has a bottom configured to provide independent standing support.

19. The convertible highchair assembly according to claim 1, wherein the booster seat includes a second seat portion and a removable backrest, the second seat portion being provided with a latching member operable to engage with the backrest for locking the backrest with the second seat portion.

20. The convertible highchair assembly according to claim 1, wherein the booster seat further includes two storage drawers for receiving at least partially a restraint harness of the booster seat.

21. A convertible highchair assembly comprising:

a seat frame including a seat portion having a first seating surface adapted to receive a child;

a booster seat having a second seating surface for receiving a child, wherein the seat portion of the seat frame is capable of receiving a child on the first seating surface independent of the booster seat;

a tray detachably installable on the booster seat over the second seating surface, the tray comprising a rigid tray body having a plurality of sockets, and a plurality of latches assembled with the rigid tray body at locations respectively adjacent to the sockets, the rigid tray body being detachable from the booster seat and attachable to the booster seat over the second seating surface; and a plurality of leg extensions selectively attachable to any of the seat frame and the tray, each of the leg extensions having a connecting end;

wherein the connecting ends of the leg extensions are attached to the seat frame for configuring a highchair, and the connecting ends of the leg extensions are respectively inserted into the sockets and locked with the tray by the latches to convert the tray to a standalone table with the leg extensions providing standing support for the tray on a floor surface, the seat frame alone without the leg extensions attached thereto forming a standalone chair.

* * * * *